US011638484B2

(12) United States Patent
Shepherd

(10) Patent No.: US 11,638,484 B2
(45) Date of Patent: May 2, 2023

(54) BORDER BENCH APPARATUS

(71) Applicant: Stephen Shepherd, Edmond, OK (US)

(72) Inventor: Stephen Shepherd, Edmond, OK (US)

( * ) Notice: Subject to any disclaimer, the term of this patent is extended or adjusted under 35 U.S.C. 154(b) by 221 days.

(21) Appl. No.: 17/322,379

(22) Filed: May 17, 2021

(65) Prior Publication Data

US 2022/0361679 A1 Nov. 17, 2022

(51) Int. Cl.
*A47C 11/00* (2006.01)
*A47C 13/00* (2006.01)
*E02D 29/02* (2006.01)

(52) U.S. Cl.
CPC ..... *A47C 11/00* (2013.01); *A47C 13/005* (2013.01); *E02D 29/0266* (2013.01)

(58) Field of Classification Search
CPC ..... A47C 11/00; A47C 11/005; A47C 11/02; A47C 13/005; E02D 29/0266
See application file for complete search history.

(56) References Cited

U.S. PATENT DOCUMENTS 3,213,570 A 10/1965 Abramson, Jr.
3,584,916 A * 6/1971 Bayes ..... A47C 11/00 297/440.22
3,748,012 A * 7/1973 Abelman ..... A47C 5/00 D6/381
4,054,316 A * 10/1977 DeLong ..... A47C 1/12 297/248
5,168,678 A 12/1992 Scott, Jr. et al.
6,733,082 B1 * 5/2004 Treon ..... A47C 1/16 297/440.22
2017/0196359 A1 * 7/2017 Paterson ..... A47C 11/00

FOREIGN PATENT DOCUMENTS

JP 2004350905 A * 12/2004 ..... A47C 11/00
KR 101786617 B1 * 10/2017 ..... A47C 11/00

* cited by examiner

*Primary Examiner* — Milton Nelson, Jr.
(74) *Attorney, Agent, or Firm* — Edward L. White, P.C.; Edward L. White

(57) ABSTRACT

A border bench apparatus providing a seating surface that can be interchangeably replaced with a retaining wall section. The border bench comprises a bench section having a seating surface, a first end to engage a lower engagement projection, a second end adapted to engage an upper engagement projection, and a body. In the preferred embodiment, more than one spike passes through the hoes defined in the bench and the wall sections for stabilization. The border bench can include a weighted base, or a broadened base.

26 Claims, 4 Drawing Sheets

BORDER BENCH APPARATUS

CROSS-REFERENCE TO RELATED APPLICATIONS

None.

FIELD OF THE INVENTION

The invention generally relates to playground equipment. Specifically, the invention relates to modular retaining wall systems for retaining cushion material around playground equipment.

BACKGROUND

It is well known to provide retaining modular retaining wall systems for playground areas. These modular systems typically are comprised of molded plastic pieces which are held in place by spikes driven into the ground for quick assembly. Adjacent retaining wall sections fit together like a puzzle with metal spikes serving as the dual function of connection points between adjacent sections of the retaining wall and as stabilizers to retain the sections in an upright position. Once a desired area is encircled with a number of retaining wall sections, the area defined by the retaining wall sections is filled with a cushioning material such as wood chips, bark, or composite materials such as shredded tires or other well-known materials. The retaining wall sections tend to be on the order of 10 inches to two feet high.

It is known in the prior art to provide pieces to coordinate with the retaining sections to provide for wheelchair handicap access to play equipment. This section tends to be the same length as the pother pieces but provide a sloped access point into the play area.

Often in playground areas parents accompanying their children. The Prior art systems do not provide any place for parents to rest while watching or monitoring their children's play. Prior art systems involved providing separate seating surfaces outside of the area defined by the modular retaining wall. The extra distance between the seating surfaces and the playground equipment with the retaining wall in between increased the response time for a person acting in loco parentis to get from the seat to the playground, if needed, to supervise or physically assist any children in their care. The additional seating surfaces also are an extra expense that must be borne by the school, municipality or other building the playground. It is therefore desired to have comfortable place for parents to rest while watching or monitoring their children near the play equipment while minimizing the cost to provide the necessary equipment.

SUMMARY OF THE INVENTION

The invention provides a seat, called a border bench, near and facing the playground equipment. Persons serving in loco parentis often need to be near play equipment to monitor children's play. The present invention provides modular equipment for use with playground retaining wall systems to provide a seat near and facing the play equipment. The invention is sized to replace at least one retaining wall section. It serves the function of retaining the fill material in place and also provides a seat near and facing the play equipment. The invention can be quickly installed in a new playground setting or can easily be swapped into place for an existing retaining wall section easily and interchangeably engaging adjacent retaining wall sections.

There have thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in this application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting. As such, those skilled in the art will appreciate that the conception, upon which this disclosure is based, may readily be utilized as a basis for the designing of other structures, methods and systems for carrying out several purposes of the present invention. Additional benefits and advantages of the present invention will become apparent to those skilled in the art to which the present invention relates from the subsequent description of the preferred embodiment and the appended claims, taken in conjunction with the accompanying drawings. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientist, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

DETAILED DESCRIPTION OF THE INVENTION

Figure 1:
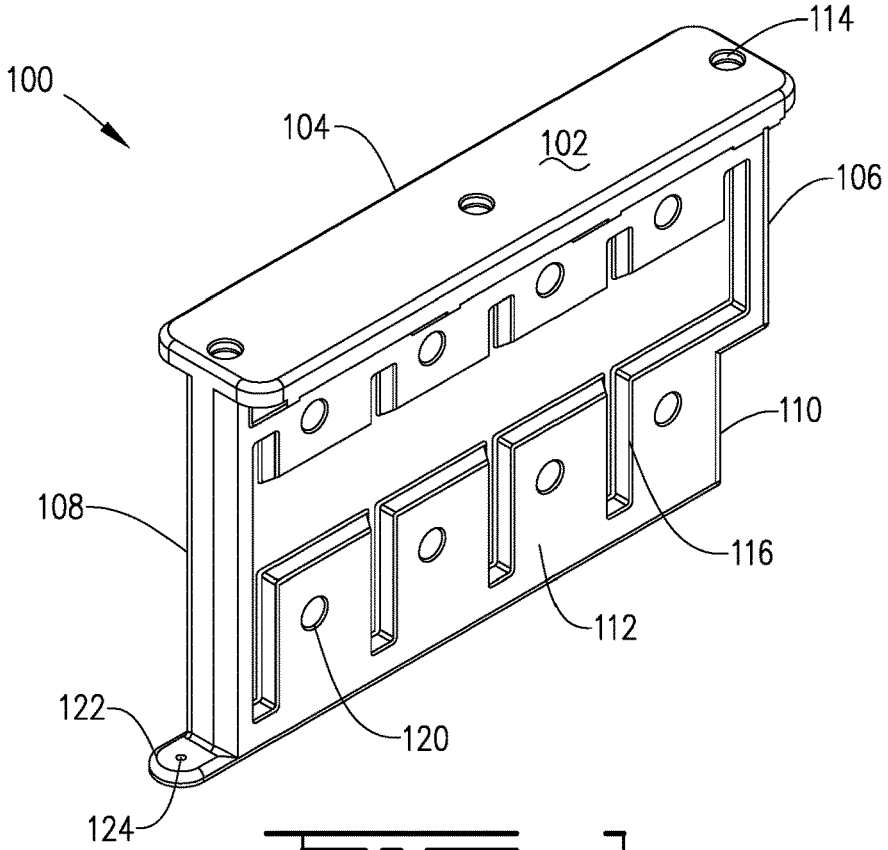
FIG. 1 is a perspective view of the border bench 100.

The border bench 100 of present invention is shown with a seating surface 102 at an upper edge 104. A first end 106 is at the right edge and a second end 108 is at the left edge. A cut-out 110 is defined in the first end. The cut-out 110 is adapted to receive and cooperate with a lower engagement projection 306 from a first wall section 302. The upper edge 104 is supported by a body 112.

The body 112 is preferably hollow, having been roto-molded or blow molded. Defined within the hollow body 112 are stiffeners of several different varieties. Geometric stiffeners 116 as well as circular stiffeners 120 are shown, though mechanical design and fabrication concerns may dictate a variety of stiffener configurations. A sign stiffener 118 is also shown. The sign stiffener 118 maintains the two sidewalls of the body 112 the desired distance from one another, preferably by joining them together physically. This same configuration applies to each of the stiffeners which generally comprise indentations that close the distance between the sidewalls and join a section of the sidewalls together. In addition to holding the sidewalls together, the sign stiffener 118 serves as a surface on which the manufacturer's information or information desired by the purchaser (such as a school name or logo) can be displayed.

A wing 122 extends out from the second end 108. The wing is adapted to engage the upper engagement projection 308 from the second wall section 304. A spike 600 passes down through the upper engagement projection 308, through the wing hole 124 and into the ground to hold the two adjoining pieces together.

The overall height of the border bench 100 is preferably greater than would normally be provided for a seating surface. Chairs usually have a seating height of around 18" give or take a couple of inches. The border bench is preferably at least 10" higher than typical chair seating height. The reason for the extra height is that persons resting on the border bench 100 usually face toward the playground equipment, in which case their feet are on the fill material, which is typically 10" or so above the surrounding ground level. Therefore, a standard chair seating height is provided for persons facing the playground equipment.

Figure 2:
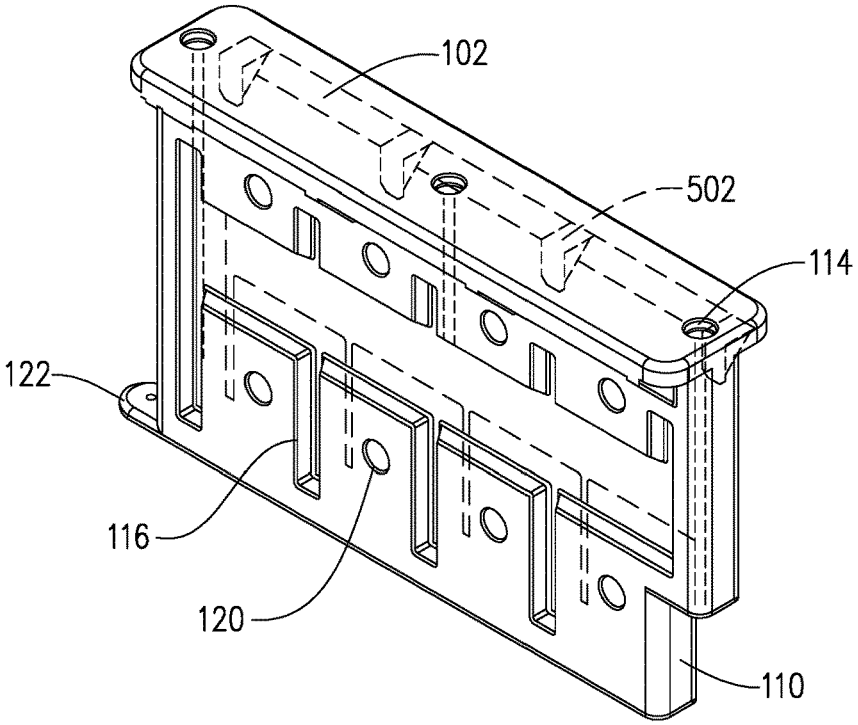
FIG. 2 is a perspective view of the border bench 100 rotated approximately 90% from FIG. 1 showing dashed lines indicting the hollow nature of the border bench in a preferred embodiment.

FIG. 2 is a perspective view of the invention with hatched lines illustrating the internal wall configuration in the preferred situation where the border bench 100 is hollow. The lines illustrate that there are exterior walls and interior hollow chambers. The upper seating surface 102 is shown as well as a stability rib 502, which can be seen more clearly in FIG. 5. The rib serves as a structural stabilizer to maintain the upper edge 104 in a fixed relationship with the body 112. FIG. 2 also allows the viewer to appreciate how the stiffeners, 116 and 120 primarily, pass between the two walls both hold the walls together in a fixed orientation as well as to provide structural stability so that the sidewalks do not buckle.

Figure 3:
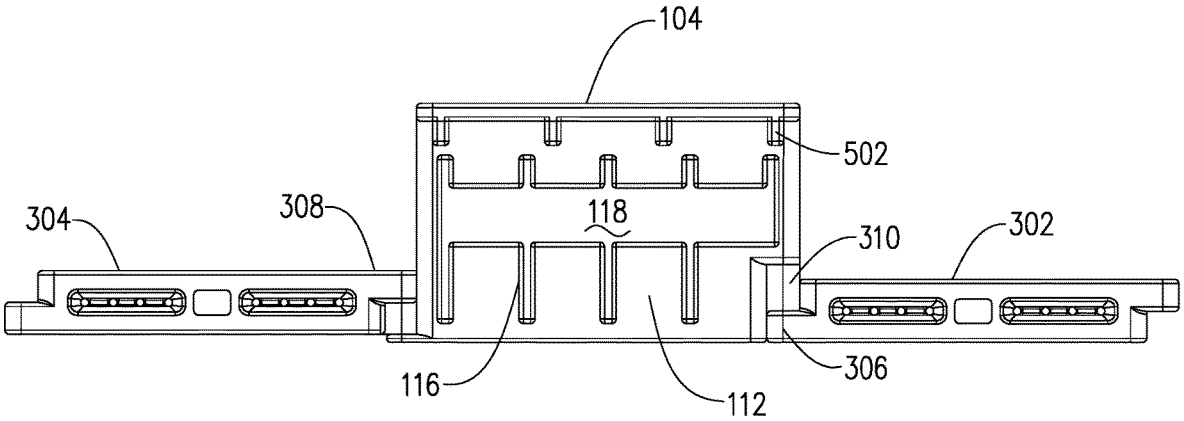
FIG. 3 is a front view of the border bench 100 engaging adjacent first and second wall sections 302 and 304.

FIG. 3 shows the border bench 100 in cooperation with a first wall section 302, a second wall section 304. The first wall section 302 has extending out from one edge thereof a lower engagement projection 306. Similarly, the second wall section 304 has extending outward at one end an upper engagement projection 308. The foregoing engagement projections are, in the preferred embodiment shown, engaged with a filler end cap 310 to fill excess space. The filler end cap 310 may be provided in different sizes. The first and second wall sections 302 and 304 may have different sizes of lower and upper engagement projections 306 and 308. Depending on the sizes of those components, different filler end caps 310 will be provided to fill the additional space. When viewed in cooperation, the cut-out 110 receives the lower engagement projection 306. Disposed there between is the filler end cap 310. A spike 600 passes all the way from the upper edge 104 down through a hole in the body 112 continuing through a hole in the filler end cap 310 and finally passing through a hole defined in the lower engagement projection 306 before entering the ground. A section of the spike extends down into the ground to provide anchoring and stability securing adjacent pieces in place connected to one another.

Figure 4:
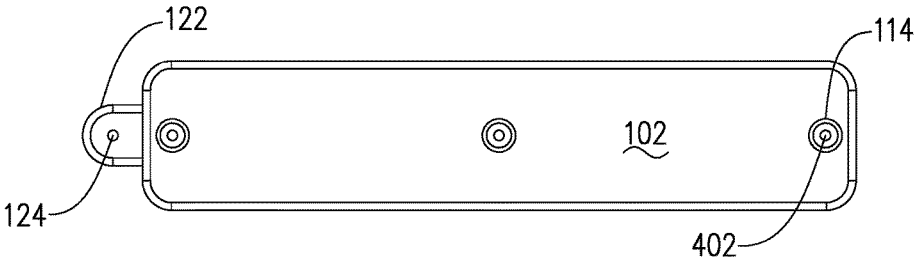
FIG. 4 is a top view of the border bench 100.

FIG. 4 is a top view of the border bench 110. The seating surface for 102 can be seen along with three indentations 114. The indentation is sized to receive the head 602 of the spike 600. A body hole 402 is centered in each of the indentations 114. The body hole 402 is sized to receive the spike 600. Also visible in the top view is the wing 122 and the wing hole 124.

Figure 5:
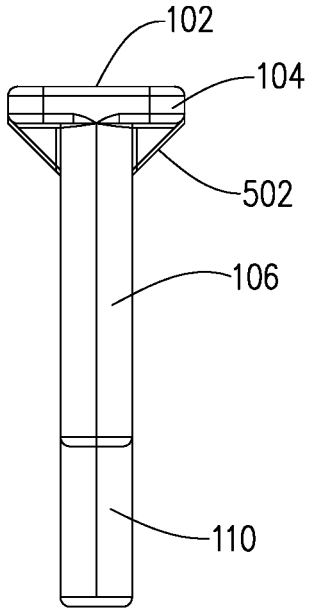
FIG. 5 is a side view of the border bench 100.

FIG. 5 is a side view of the border bench 100. The cut-out 110 can be seen at the lower portion of the body 112. Disposed underneath the upper edge 104 is preferably a rib 502 which provides stability. A plurality of ribs may be disposed along the length of the upper edge 104 for providing stability thereto. See FIG. 3 showing four ribs. The seating surface 102 can be seen in relation to the upper edge 104. In the preferred embodiment where the border bench 100 is hollow, there may be a chamber defined with the upper edge.

Figure 6:
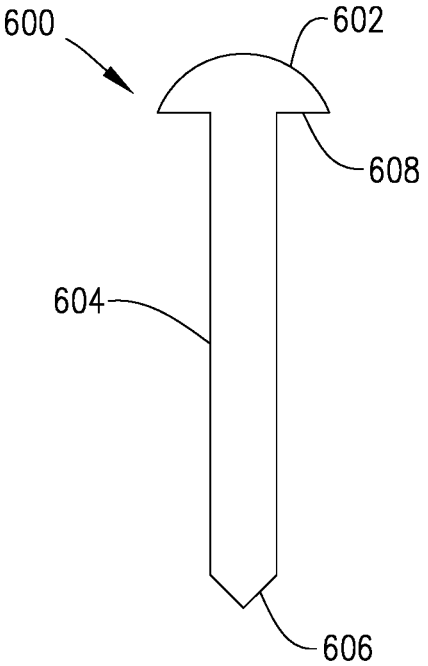
FIG. 6 is a side view of the stake 600.

FIG. 6 illustrates the spike 600. At an upper hand is the head 602 which has on its lower portion some shoulders 608 to engage the indentation 114. The shaft 604 is sized to pass through the body hole 402 of the border bench 100. At a lower portion is preferably a point 606 to facilitate driving the spike 600 into the ground. Optionally, covers may be provided for the indentations 114. Those skilled in the art will be aware of a wide variety of cap covers some with press-fit, and some having a portion that passes up the shaft 604 to be retained under the shoulders 608 with a hinged cap engaging an upward projection from the portion retained under the shoulders.

Figure 7:
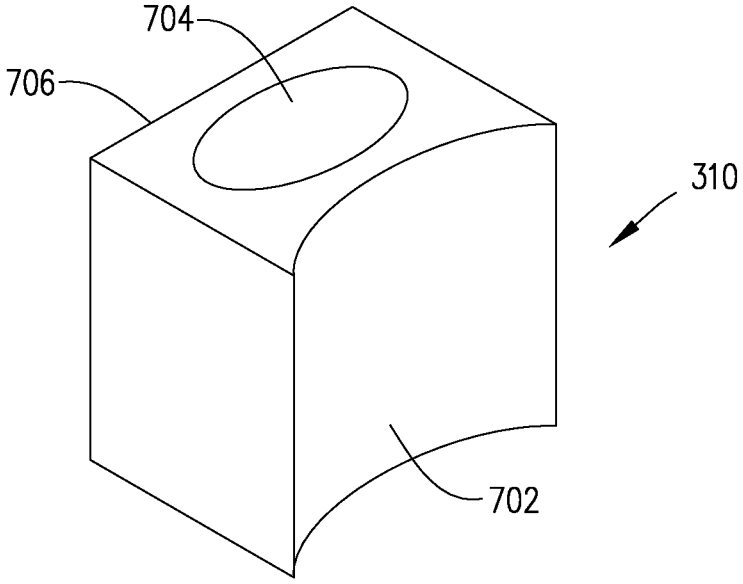
FIG. 7 is a perspective view of a filler end cap 310.

FIG. 7 is a perspective view of the filler end cap 310. 702 is a first shaped surface adapted to engage a corresponding edge of the border bench 100. The second shape surface 706 is adapted to engage one of the wall sections 302 and 304. The shaped surfaces 702 and 706 allow for adjacent wall sections and the border bench to be disposed at a wide range of angles relative to one another. Defined through the filler end cap 310 is an end cap hole 704. The end cap hole 704 is sized to receive the shaft 604 of the spike 600.

Figure 8:
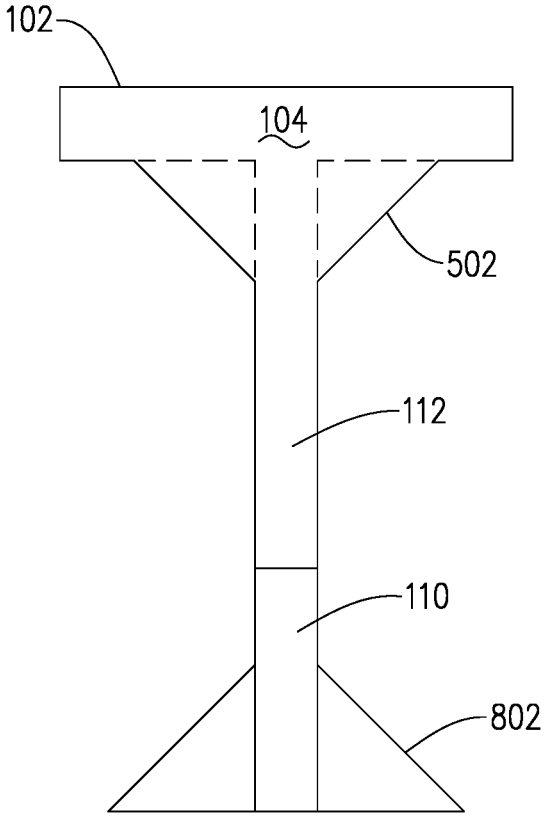
FIG. 8 is a side view of an embodiment of the border bench 100 with a broadened base 802.

FIG. 8 is a side view of the border bench 100 having a broadened base 802 to provide stabilization means. The ribs 502 can be clearly seen in the side view. This view is shown from the perspective that allows the viewer to see the cut-out 110. In either this configuration or the configuration shown in FIG. 5, a lower portion of the border bench 100 may be filled with sand, water, metal or other material providing weight to the border bench to provide additional stability.

Having thus described the invention, I claim:

1. A border bench comprising:

a. A first wall section having a first end affixed to an adjoining continuation section and a second end defining a lower engagement projection defining a hole therein;

b. A second wall section having a first end attached to a second adjoining continuation section and a second end defining an upper engagement projection defining a hole therein;

c. A bench section having— i. an upper edge defining a seating surface, ii. a first end defining a cutout shaped to engage the lower engagement projection, iii. a second end defining a hole therein adapted to engage the upper engagement projection, and iv. a body;

d. A pair of connection means for connecting the first and second ends of the bench to adjacent wall section ends; and e. A stabilization means for retaining the bench in an upright stable position;

WHEREBY, a wall section can be interchangeably replaced with a border bench section providing a seating surface.

2. The border bench of claim 1, the connection means and stabilization means both comprising more than one spike passing through holes defined in the bench and the wall sections.

3. The border bench of claim 2, the spike having a head at the top end and the seating surface defining therein indentations for each spike sized to receive the head at a level not higher than the seating surface.

4. The border bench of claim 3, where each indentation is configured to receive a cap to cover the head.

5. The border bench of claim 1, the connection means comprising press-fit components defined on each end of the bench cooperating with corresponding press-fit components on each end of adjacent wall sections.

6. The border bench of claim 1, the stabilization means comprising a broadened base at a bottom edge of the bench.

7. The border bench of claim 1, the stabilization means comprising a weighted base at a bottom edge of the bench.

8. The border bench of claim 1, the bench comprised of molded plastic.

9. The border bench of claim 8, the bench defining a hollow cavity therein with the body comprised of a pair of sidewalls.

10. The border bench of claim 9, where structural stiffeners are formed in the pair of sidewalls.

11. The border bench of claim 10, an area defined for use as a sign.

12. The border bench of claim 10, where the structural stiffeners are selected from geometric shapes.

13. The border bench of claim 1, where the border bench is comprised of a material selected from polyvinyl chloride, high-density polyethylene, and ultra-high-molecular-weight polyethylene.

14. The border bench of claim 1, at least one filler end cap provided and sized to accommodate a variety of heights of engagement projections.

15. The border bench of claim 1, at least one rib providing structural stability to the upper edge.

16. A border bench comprising:

a. A first wall section having a first end affixed to an adjoining continuation section and a second end defining a lower engagement projection defining a hole therein;

b. A second wall section having a first end attached to a second adjoining continuation section and a second end defining an upper engagement projection defining a hole therein;

c. A bench section having— i. an upper edge defining a seating surface, ii. a first end defining a cutout shaped to engage the lower engagement projection, iii. a second end defining a hole therein adapted to engage the upper engagement projection, and iv. a body;

d. A pair of connection means for connecting the first and second ends of the bench to adjacent wall section ends; and e. A stabilization means for retaining the bench in an upright stable position;

WHEREBY, a wall section can be interchangeably replaced with a border bench section providing a seating surface.

17. The border bench of claim 16, the connection means and stabilization means both comprising four spikes passing through holes defined in the bench and the wall sections.

18. The border bench of claim 17, the spike having a head at the top end and the seating surface defining therein indentations for each spike sized to receive the head at a level not higher than the seating surface.

19. The border bench of claim 18, where each indentation is configured to receive a cap to cover the head.

20. The border bench of claim 16, the connection means comprising press-fit components defined on each end of the bench cooperating with corresponding press-fit components on each end of adjacent wall sections.

21. The border bench of claim 16, the bench comprised of molded plastic selected from polyvinyl chloride, high-density polyethylene, and ultra-high-molecular-weight polyethylene.

22. The border bench of claim 21, the bench defining a hollow cavity therein with the body comprised of a pair of sidewalls.

23. The border bench of claim 22, where structural stiffeners are formed in the pair of sidewalls selected from geometric shapes.

24. The border bench of claim 23, an area defined for use as a sign.

25. The border bench of claim 16, at least one filler end cap provided and sized to accommodate a variety of heights of engagement projections.

26. The border bench of claim 16, a pair of four ribs providing structural stability to the upper edge.

* * * * *